US007623024B2

(12) United States Patent
Chen et al.

(10) Patent No.: US 7,623,024 B2
(45) Date of Patent: Nov. 24, 2009

(54) ADJUSTABLE DOOR CHIME WITH INTERCHANGEABLE PARTS

(75) Inventors: Wen-Chin Chen, Taipei (TW); Chun Teng Tan, George Town (MY)

(73) Assignee: IQ Group SDN BHD, Paulau Penang (MY)

( * ) Notice: Subject to any disclaimer, the term of this patent is extended or adjusted under 35 U.S.C. 154(b) by 263 days.

(21) Appl. No.: 11/747,720

(22) Filed: May 11, 2007

(65) Prior Publication Data

US 2007/0279198 A1 Dec. 6, 2007

Related U.S. Application Data

(60) Continuation-in-part of application No. 11/512,965, filed on Aug. 30, 2006, now Pat. No. 7,471,210, which is a division of application No. 10/798,836, filed on Mar. 11, 2004, now Pat. No. 7,126,490.

(60) Provisional application No. 60/503,626, filed on Sep. 17, 2003, provisional application No. 60/916,499, filed on May 7, 2007.

(51) Int. Cl.
*G08B 3/00* (2006.01)

(52) U.S. Cl. ..... 340/328; 340/326; 340/692; 340/392.1; 340/392.2; 340/384.1; 116/153

(58) Field of Classification Search ..... 340/328, 340/326, 692, 392.1, 393.3, 384.1, 825.31, 340/825.32; 116/9, 10, 153
See application file for complete search history.

(56) References Cited

U.S. PATENT DOCUMENTS

| | | | | |
|---|---|---|---|---|
| 2,447,226 | A | 8/1948 | Bennett | |
| 5,077,452 | A | 12/1991 | Mathers et al. | |
| 6,028,504 | A * | 2/2000 | Segan | 340/328 |
| 2006/0220797 | A1 | 10/2006 | Valentino et al. | |
| 2007/0237920 | A1 * | 10/2007 | Schoulz | 428/67 |

* cited by examiner

*Primary Examiner*—Daryl Pope
(74) *Attorney, Agent, or Firm*—Botkin & Hall, LLP

(57) ABSTRACT

The present invention is a door chime. The door chime has a decorative cover connected to a sound module including sound controls. The decorative cover is shiftable relative to the sound module from a first position in which the decorative chime will be displayed during normal use, to a second position to allow access to the sound controls in the second position. The connection between the sound module and the decorative cover allows for either a sliding connection or a rotating connection depending on the desired configuration. The power module for the door chime is interchangeable between a battery powered and hard wired module.

7 Claims, 10 Drawing Sheets

ADJUSTABLE DOOR CHIME WITH INTERCHANGEABLE PARTS

CROSS REFERENCE TO RELATED APPLICATIONS

This application is a Continuation-in-Part of U.S. patent application Ser. No. 11/512,965, filed Aug. 30, 2006, now U.S. Pat. No. 7,471,210 which is a Divisional of Ser No. 10/798,836 filed Mar. 11, 2004 now U.S. Pat. No. 7,126,490, issued Oct. 24, 2006, which claims priority to U.S. Provisional Application for Patent 60/503,626, filed Sep. 17, 2003, the disclosures of which are hereby incorporated by reference. This application also claims priority to and incorporates by reference U.S. Provisional Application for Patent No. 60/916,499, filed May 7, 2007.

SUMMARY OF THE INVENTION

Door chimes commonly sold are often sold as a complete assembly without the ability to change the configuration of a particular door chime assembly to suit a customer's style preferences. This means a retailer must stock an entire assembly for each style of door chime the retailer would like to sell. For instance, one decorative style of door chime may come in a battery powered model, as well as a hard wired model, which is attached to existing wiring in a home. Although the same in appearance, if a retailer wishes to sell a battery powered model and a hard wired model, this would require stocking two different door chimes. The number of door chimes needed in stock increases when considering the possibility of multiple decorative styles, combined with the fact that a customer may want to purchase different particular styles in either a hard wired or battery powered configuration.

There remains a need for a door chime with interchangeable parts to allow for reduced inventory.

The present invention is a door chime. The door chime has a decorative cover connected to a sound module including sound controls. The decorative cover is shiftable relative to the sound module from a first position to a second position. In the first position, the decorative cover is located where it is during normal use with respect to the sound module. The second position allows access to the sound controls on the sound module. The connection between the sound module and the decorative cover allows for either a sliding connection or a rotating connection depending on the desired configuration. The power module for the door chime is interchangeable between a battery powered and hard wired module.

An object of the invention is to provide a door chime which allows access to sound controls on the sound module without removing the decorative cover.

Another object of the invention is to provide a door chime which allows different decorative covers to be used with one sound module.

Another object of the invention is to provide a door chime having different power modules to be used with the same sound module.

Still other objects of the invention will become apparent upon a reading of the following description.

DETAILED DESCRIPTION OF INVENTION

Figure 13:
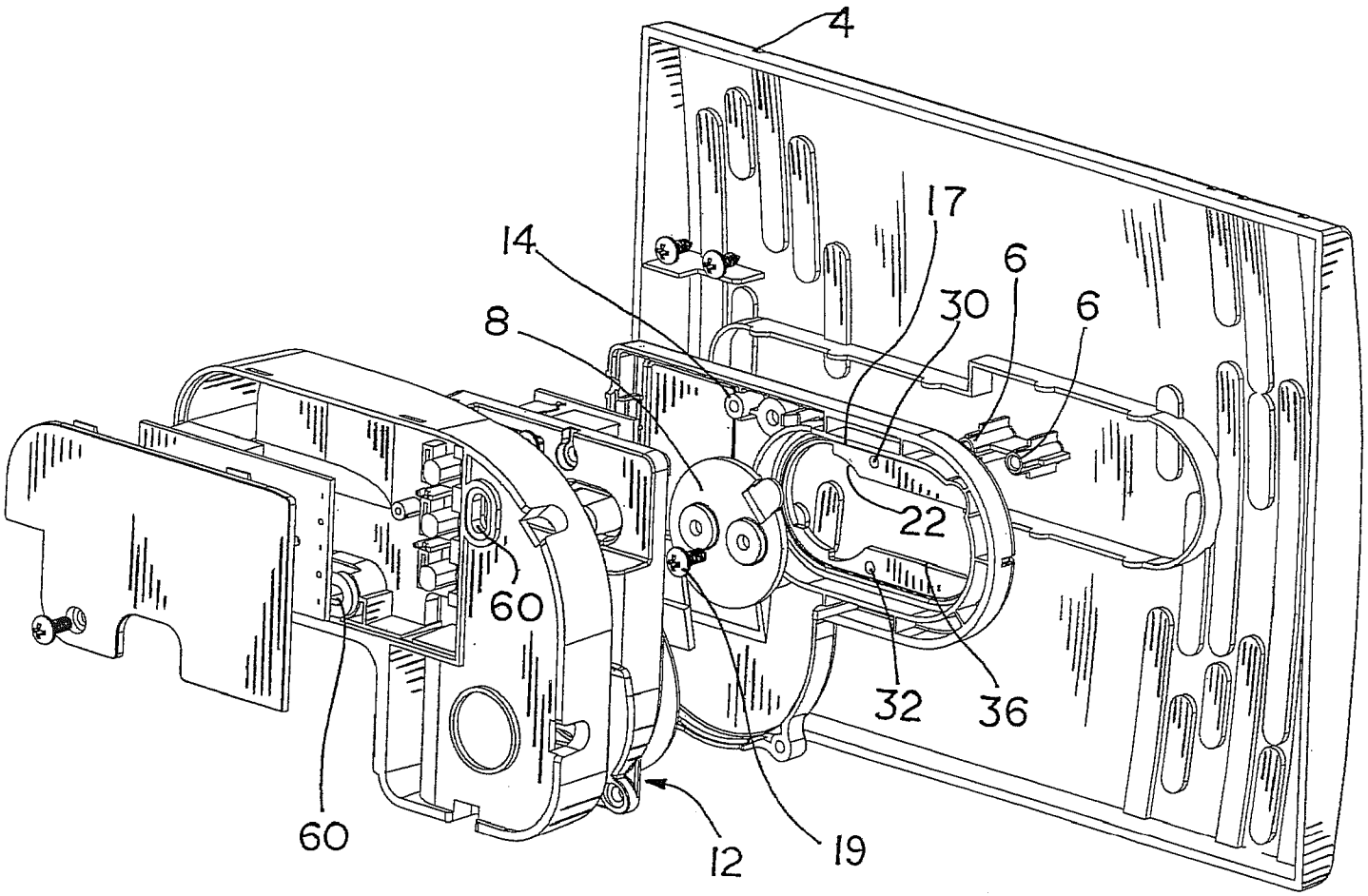
FIG. 13 is an exploded view of the door chime.

A door chime 2 of this invention has a decorative cover 4 that includes mounting bosses 6. Attached to the mounting bosses 6 is either a slide plate 8 or a rotate plate 10. The mounting bosses 6, shown in FIG. 13, accept screws 19 driven through the slide plate 8 or the rotate plate 10 depending on which is used.

Figure 4:
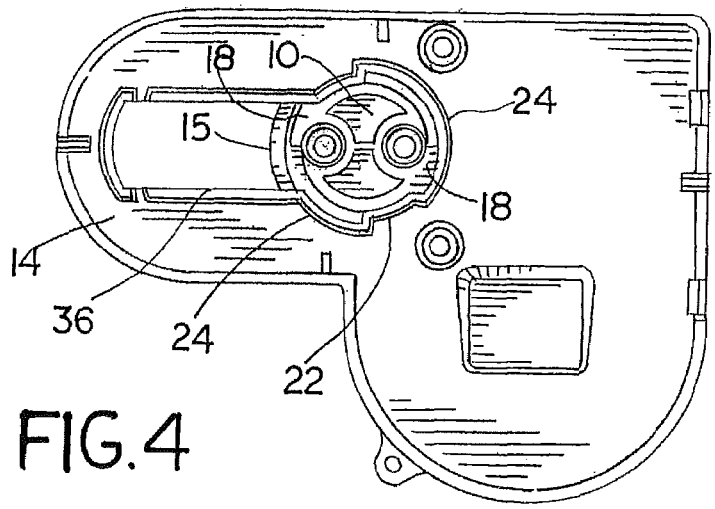
FIG. 4 shows the interaction of the rotate plate and front cover of the sound module of the chime as viewed from the decorative plate. This view corresponds to zero degrees of rotation and is the position at which the decorative cover would be normally displayed.
Figure 5:
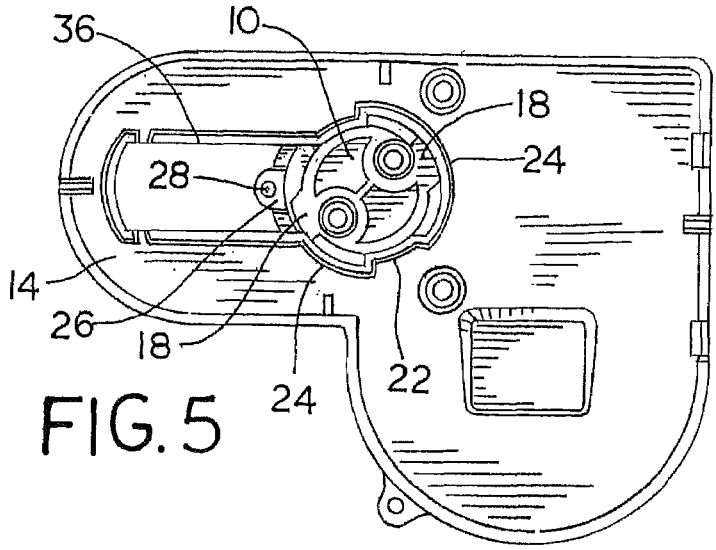
FIG. 5 shows the interaction of the rotate plate and front cover of the sound module of the chime as viewed from the decorative plate. This view corresponds to 45 degrees of rotation and is a transition position as the decorative cover is rotated to access the sound controls.
Figure 6:
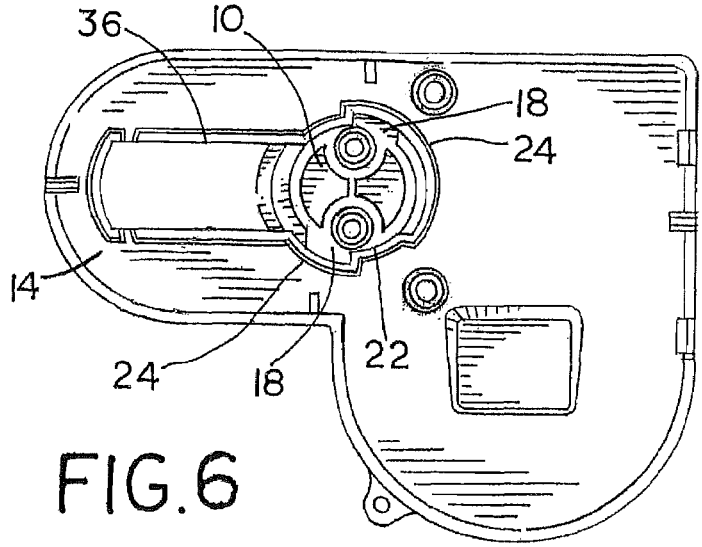
FIG. 6 shows the interaction of the rotate plate and front cover of the sound module of the chime as viewed from the decorative plate. This view corresponds to 90 degrees of rotation and is the position that allows access to the sound controls.

The door chime 2 has a sound module 12, which in one embodiment is held to the decorative cover 4 by rotate plate 10. The sound module has a front cover 14, and sound controls 21. The front cover 14 is retained between the rotate plate 10 and the decorative cover. This is accomplished by the rotate plate 10 being received within a circular hole 22 in the front cover 14 of the sound module as shown in FIGS. 4, 5, and 6. The mounting bosses 6 are chosen to be a height that will allow screws 19 to be fully tightened to secure plate 10 to cover 4 and still allow the cover 4 to rotate relative to the sound module 12. The rotate plate 10 has protrusions 18 extending out from a circular surface 20. The circular surface 20 of the rotate plate 10 rests upon a shoulder defining the circular hole 22 in the front cover 14. The circular hole 22 has annular quadrant cutouts 24 which receive the protrusions 18 of the rotate plate 10. The rotate plate 10 may only rotate 90 degrees relative to the sound module 12 and is stopped from rotating more than 90 degrees due to the protrusions 18 contacting the ends of the annular quadrant cutouts 24 as shown in FIG. 6.

Figure 1:
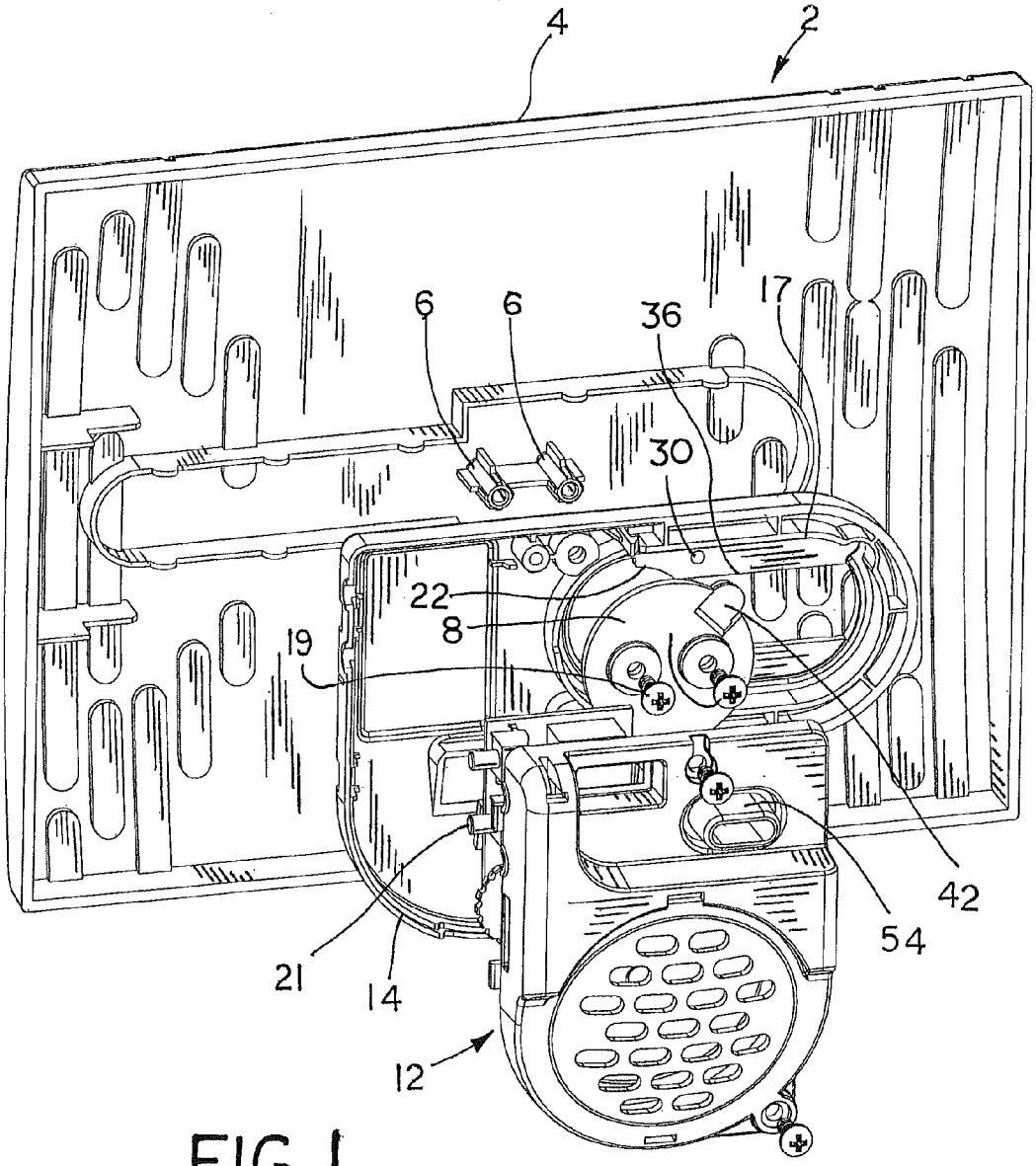
FIG. 1 is an exploded view of the door chime from the rear.
Figure 2:
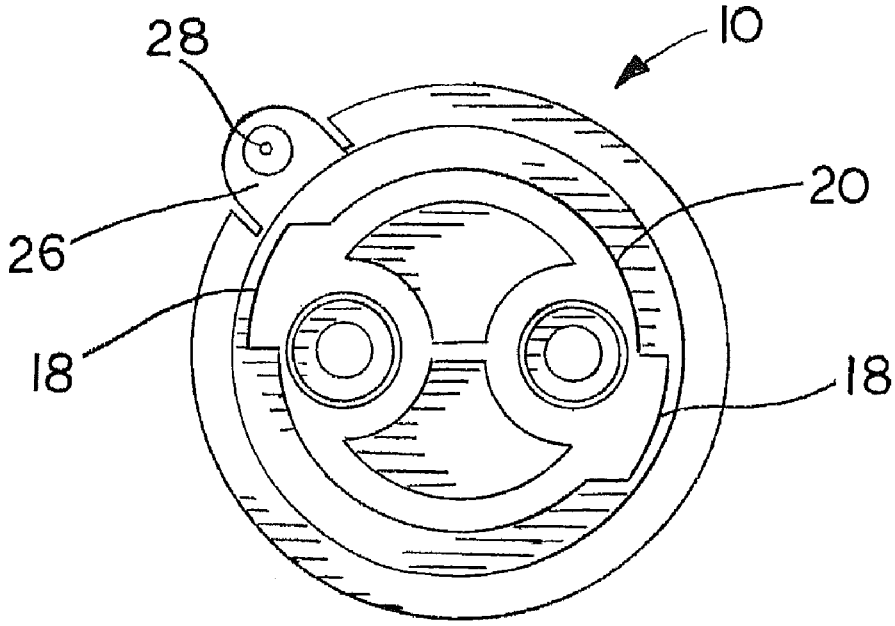
FIG. 2 shows the rotate plate part of the chime.
Figure 3:
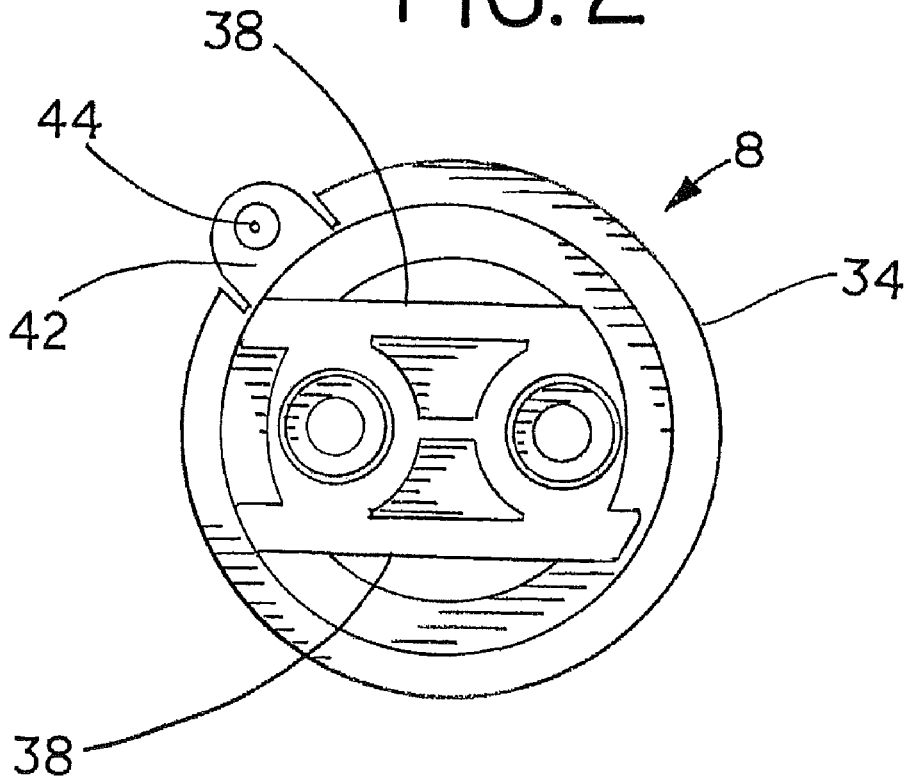
FIG. 3 shows the slide plate part of the chime.
Figure 8:
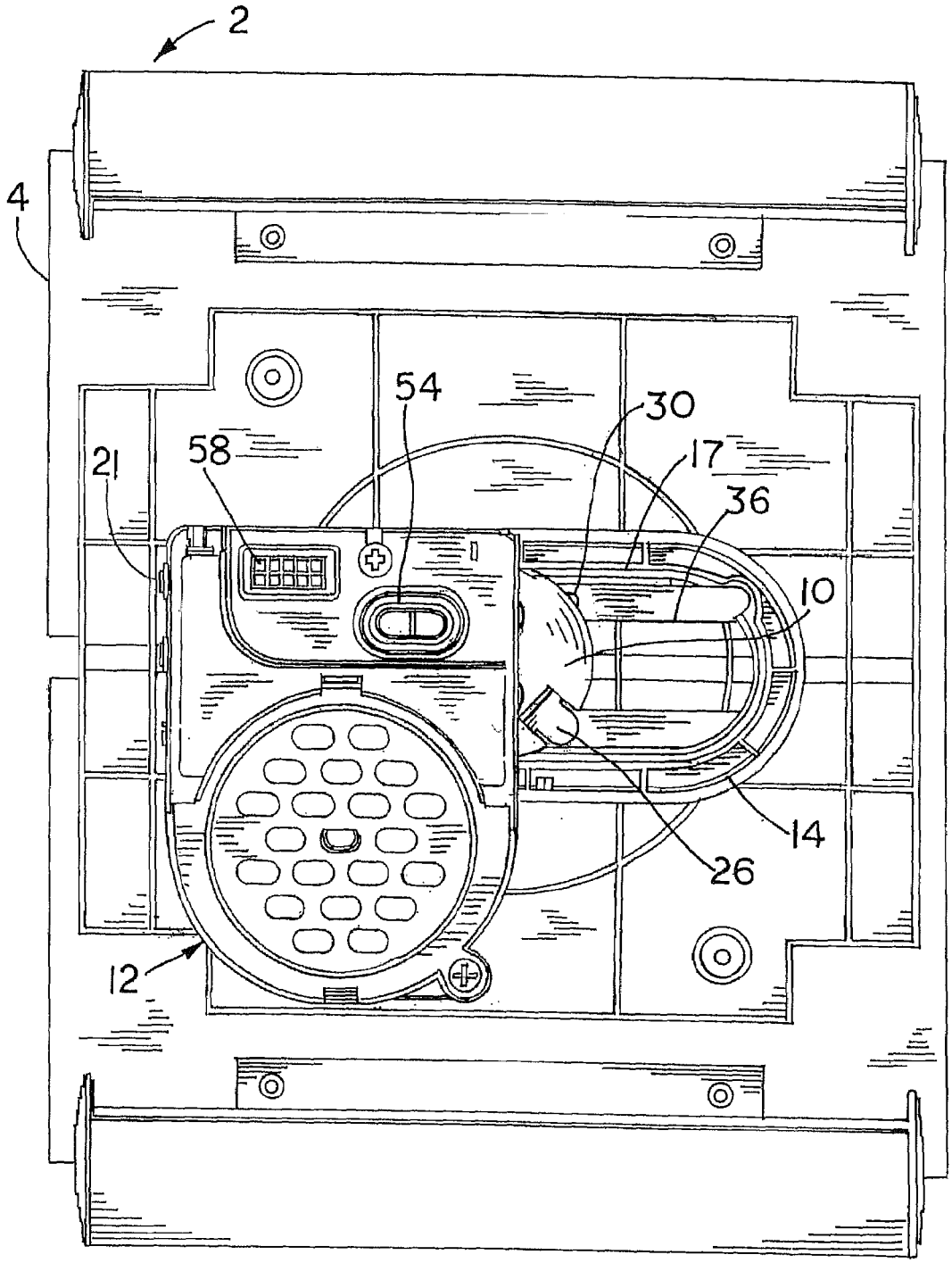
FIG. 8 is a rear view of the decorative cover, rotated 90 degrees corresponding to the position shown in FIG. 6.

The rotate plate 10 has a radial flange 26 that carries a protrusion 28. The protrusion 28 can be seen in FIGS. 2 and 5. In the preferred embodiment the protrusion 28 is spherical in shape. The front cover 14 has a first detent divot 30 and a second detent divot 32 which can be seen in FIGS. 12 and 13. The detent divots 30, 32 are spherical depressions in the preferred embodiment and serve as locators for the decorative cover 4. When the rotate plate 10 is in the 0 degree normal, or unrotated position, as shown in FIG. 4, the protrusion 28 on the radial flange 26 engages the first detent divot 30. When the rotate plate 10 is in the 90 degree rotated position as shown in FIGS. 6 and 8, the protrusion 28 engages the second detent divot 32. A small amount of turning force is required to disengage the protrusion 28 from either detent divot 30, 32.

Figure 9:
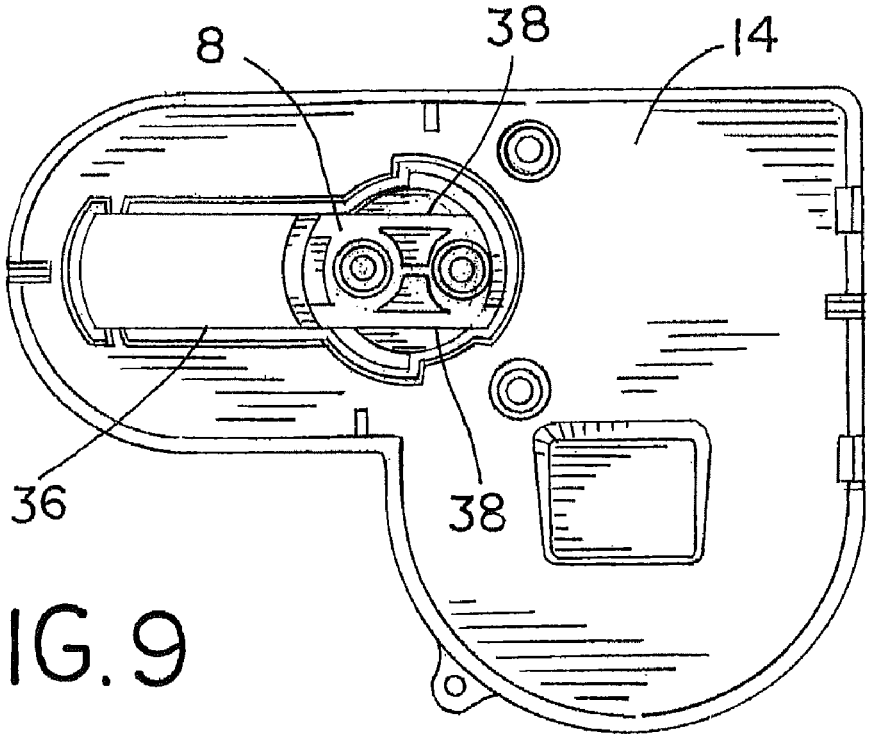
FIG. 9 shows the interaction of the slide plate part and front cover of the sound module of the chime as viewed from the decorative plate. This view corresponds to a centered position and is the position at which the decorative cover would normally be displayed.
Figure 10:
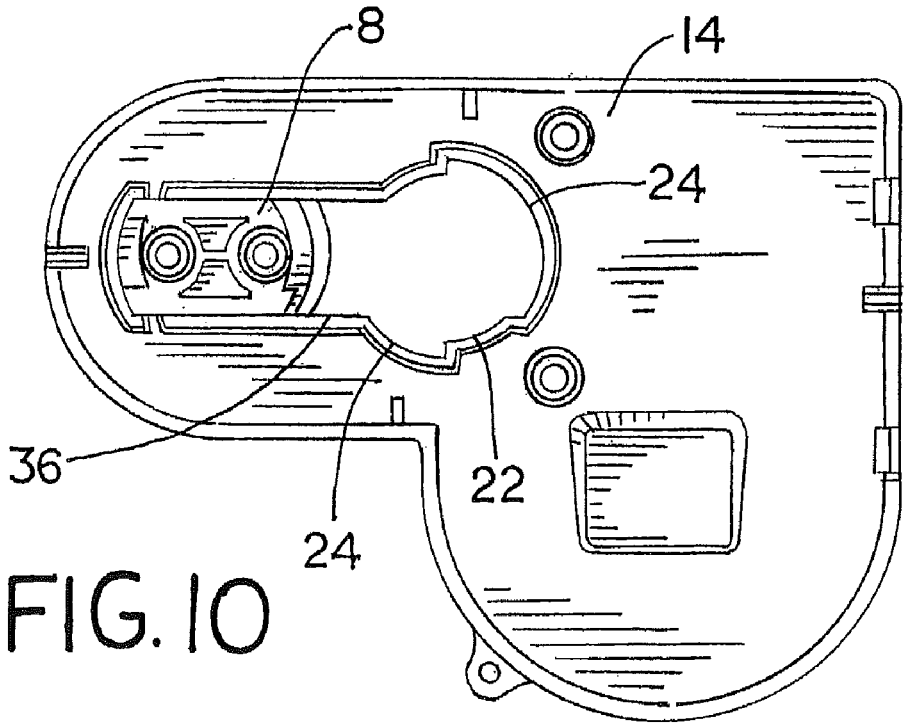
FIG. 10 shows the interaction of the slide plate part and front cover of the sound module of the chime as viewed from the decorative plate. This view corresponds to a position where the decorative cover is slid to one side allowing access to the sound controls.
Figure 11:
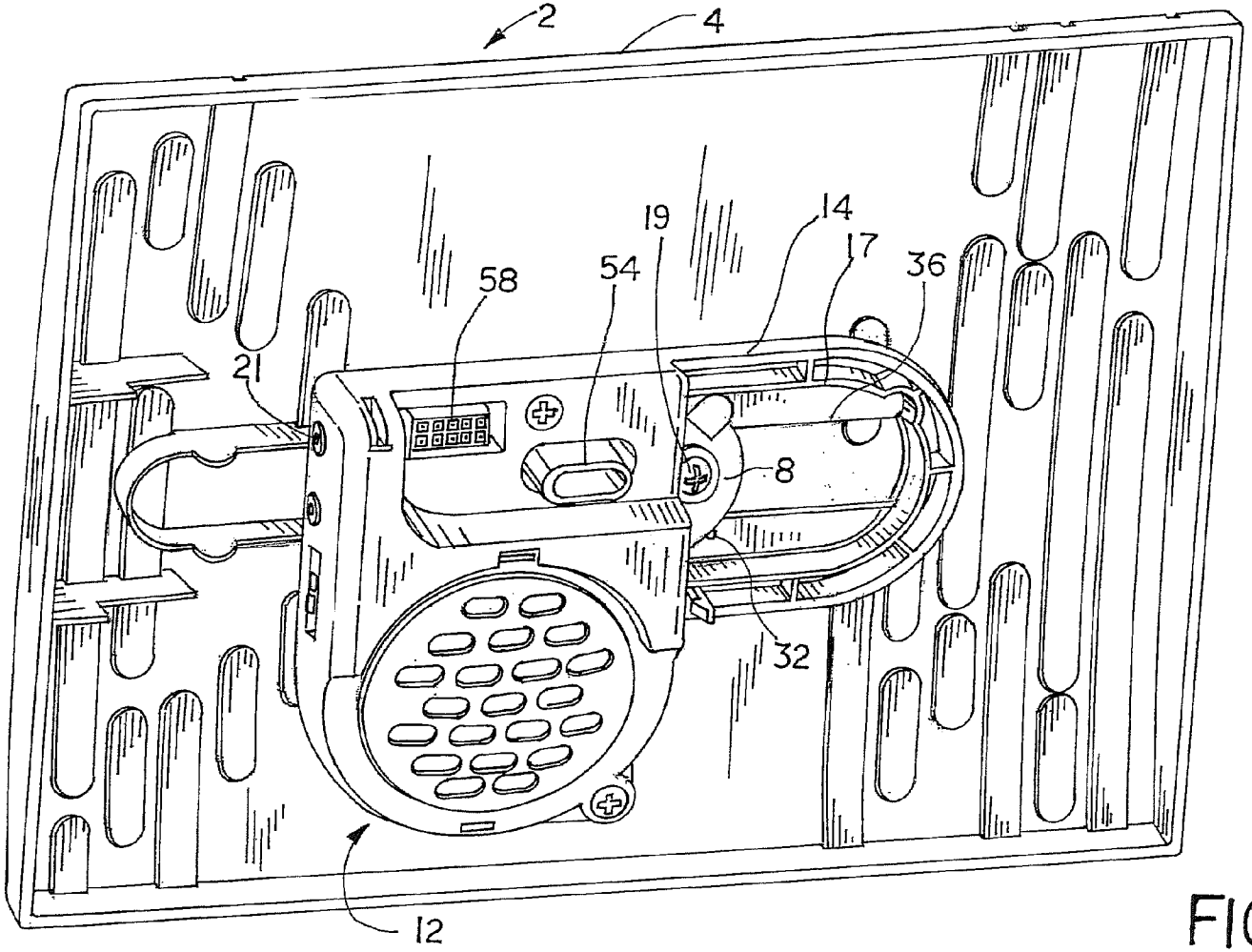
FIG. 11 shows the decorative cover as viewed from the rear, in its centered position corresponding to the position shown in FIG. 9.

In another embodiment, the front cover 14 of the sound module 12 is attached by screws 19 to the decorative cover 4 at bosses 6 by slide plate 8. The slide plate 8 fits into front cover 14. Since the diameter 34 on the slide plate is larger than the diameter of the circular hole 22 in the front cover 14, the front cover is retained, as shown in FIGS. 9 and 10. A slot 36 extends from hole 22 in the front cover 14. The slide plate has parallel flat sides 38 that engage the slot 36. The flat sides 38 are long enough so that when the slide plate 8 is at the end of slot 36 the flat sides 38 extend beyond the annular quadrant cutouts 24, thereby preventing rotation. The slide plate 8 has a radial flange 42 that carries a protrusion 44. FIGS. 9 and 10 show how the slide plate 8 interfaces with the front cover 14. When the slide plate 8 is centered, or as displayed in the position as shown in FIG. 9, the protrusion 44 on the radial flange 42 engages the first detent divot 30. When the slide plate is slid to one side to access the sound controls 21, as shown in FIG. 10, the protrusion rests on the front cover 14. A small amount of lateral force is required to disengage the protrusion from detent divot 30.

Figure 15:
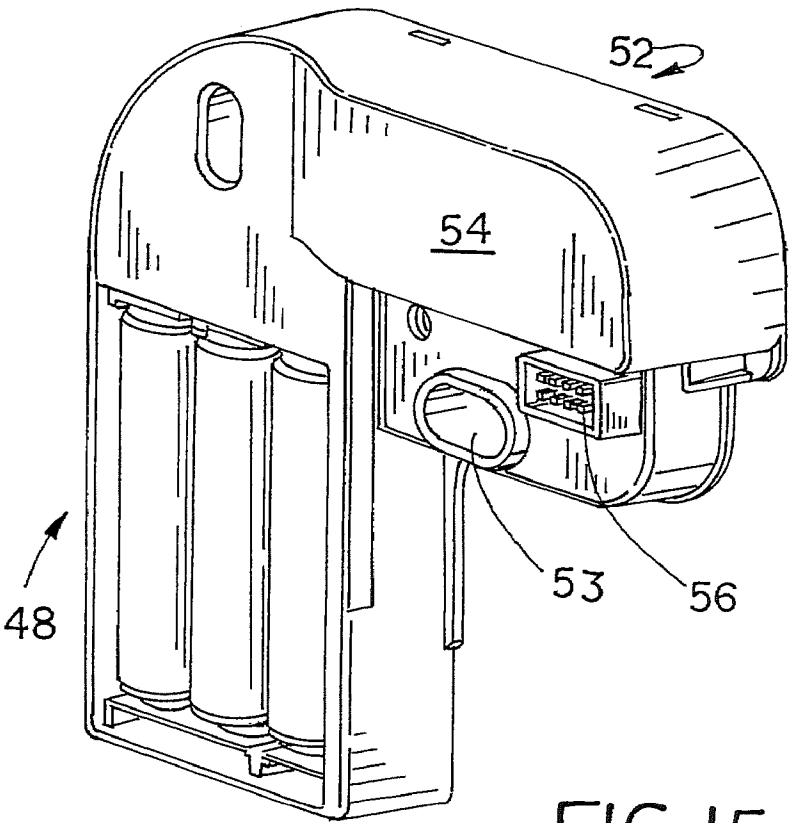
FIG. 15 is a perspective view of the battery powered module.
Figure 14:
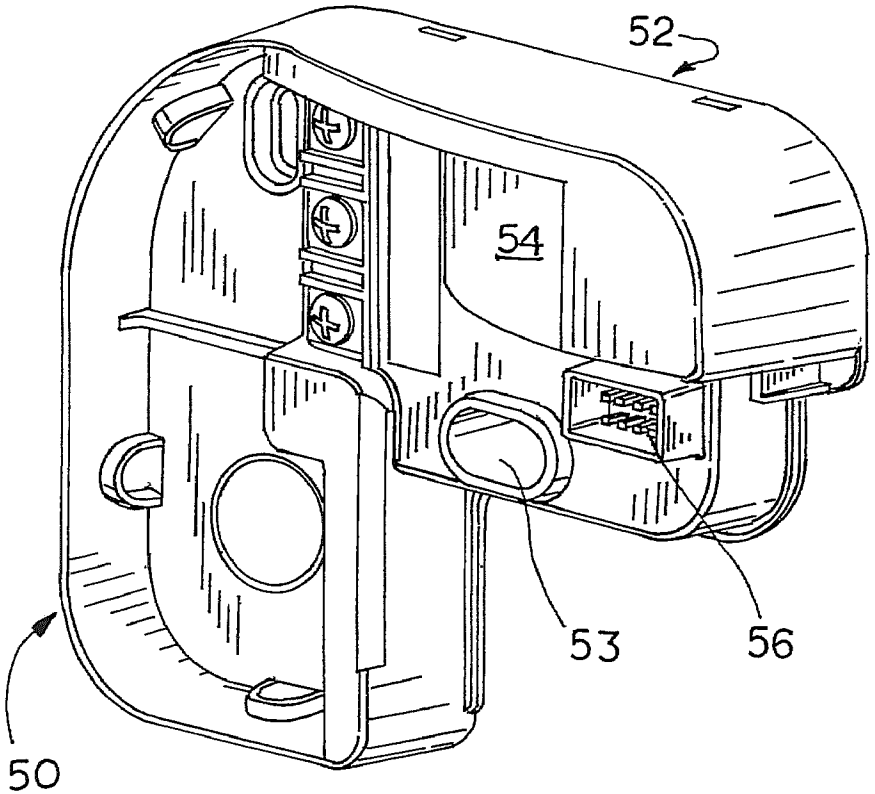
FIG. 14 is a perspective view of the hard wired power module.

A power module 48 or 50 is attached to the back of the sound module 12 by the pin header and a friction fit of an oblong boss 54 into an oblong boss receptacle 53 on a power module 48, 50. The power module is either a battery powered module 48 or a hard wired module 50. The pin header 56 on the power module 48 or 50, as shown in FIGS. 14 and 15, mates with female pin header socket 58 on the sound module. Either a battery powered module 48 or a hard wired module 50 connectable to a household electrical circuit may be used since they are interchangeable. Both modules 48, 50 have mounting holes 60 through which screws are inserted to attach the power module 52 to a wall.

Figure 7:
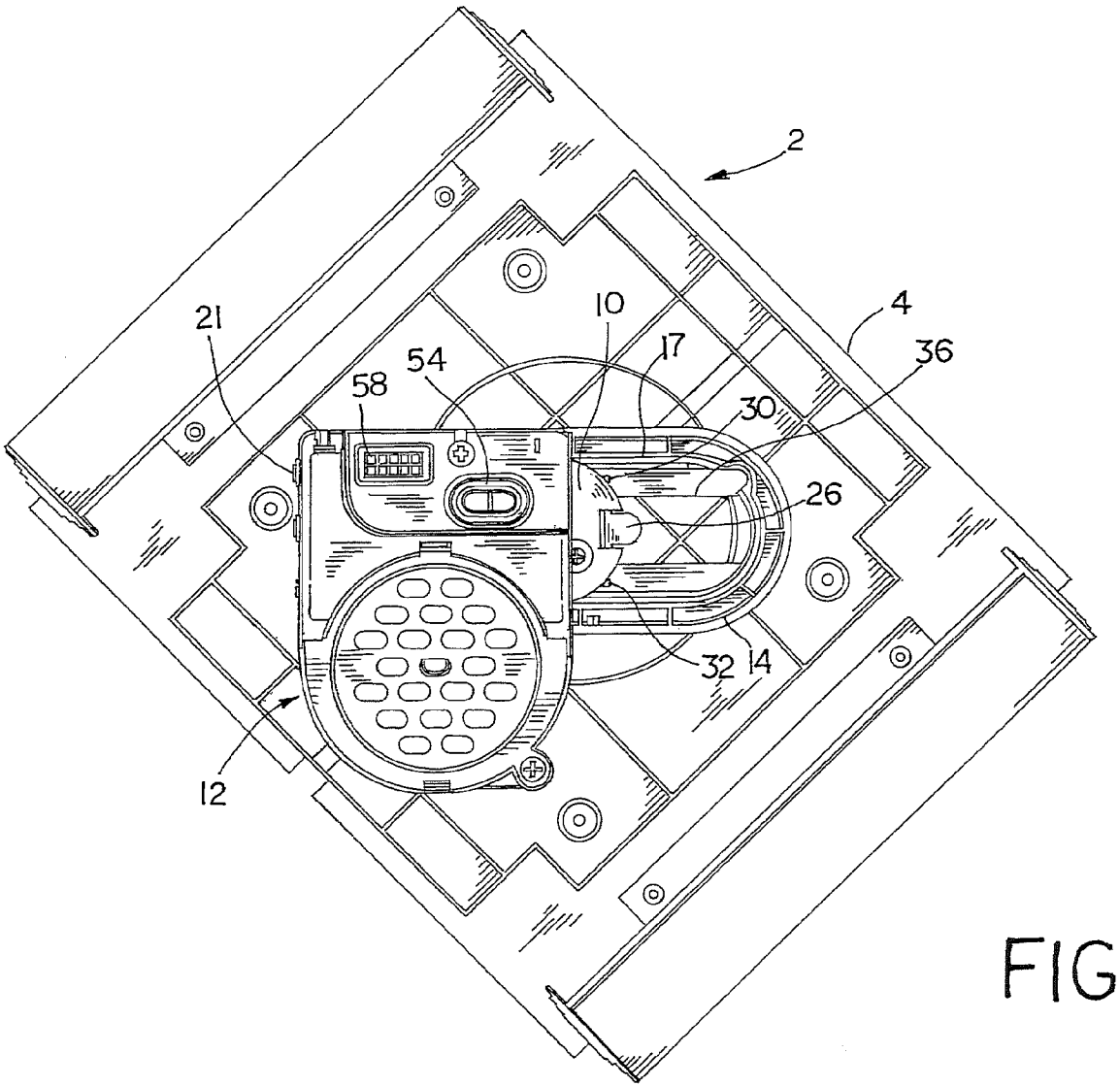
FIG. 7 is a rear view of the decorative cover, rotated 45 degrees corresponding to the position shown in FIG. 5.
Figure 12:
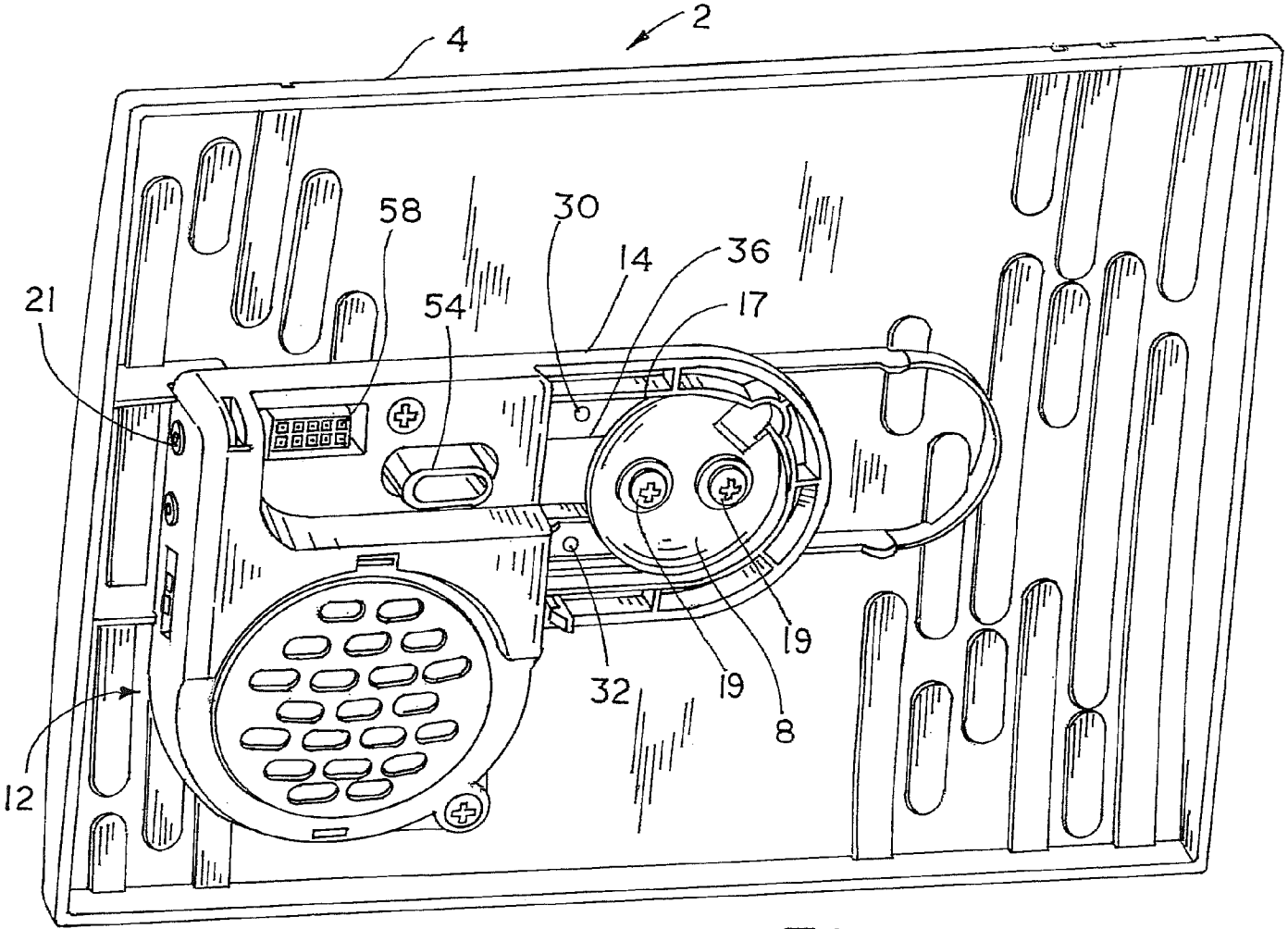
FIG. 12 shows the decorative cover as viewed from the rear, slid to one side to allow access to the sound controls. This corresponds to the position shown in FIG. 10.

When a customer selects a door chime 2 of this invention, first a decorative style is chosen. The decorative style is defined by the type of decorative cover 4. Each decorative cover 4 may be affixed to the sound module 12 using either a slide plate 8 or a rotate plate 10. Certain decorative covers 4 will have shapes that will make reaching the sound controls 21 on the sound module 12 easiest when the decorative cover 4 is rotated. When this is the case, a rotate plate 10 should be used. The rotate plate 10 allows the decorative cover 4 to rotate 90 degrees. FIGS. 7 and 8 show how the rotate plate allows access to the sound controls when the cover 4 is rotated. Other decorative covers 4 will have shapes that will make reaching the sound controls 21 easiest when the decorative cover 4 is slid to one side. When this is the case, a slide plate 8 should be used. FIG. 12 shows the decorative cover 4 slid to the side to allow access to the sound controls 21.

What is claimed is:

1. A door chime comprising:

a decorative cover;

a sound module connected to said decorative cover;

said module including adjustment controls;

said decorative cover having a first position and a second position, said cover being shiftable relative to said sound module between said first and second positions, wherein said sound controls are accessible in said second position, a rotate plate attached to said decorative cover, said sound module having a front cover, said front cover of said sound module rotatably held between said decorative cover and said rotate plate to accommodate movement of said decorative cover between said first and second positions.

2. A door chime as claimed in claim 1, wherein said front cover of said sound module has a circular hole having at least one cutout, said rotate plate having at least one protrusion on a circular surface engaging said circular hole in said front cover of said sound module, each protrusion extending into and engaging ends of a said cutout such that said decorative cover is limited in rotation with respect to said sound module between said first and second position.

3. A door chime as claimed in claim 1, wherein said rotate plate has a protrusion on a radial flange which releasably engages a detent divot in said front cover, when in said first position.

4. A door chime as claimed in claim 1, wherein said sound module includes a power supply, said power supply being interchangeable between battery powered and household circuit powered.

5. A door chime comprising:

a decorative cover;

a sound module connected to said decorative cover;

said module including adjustment controls;

said decorative cover having a first position and a second position, said cover being shiftable relative to said sound module between said first and second positions, wherein said sound controls are accessible in said second position; a slide plate attached to said decorative cover, said sound module having a front cover, said front cover of said sound module slidingly held between said decorative cover and said slide plate to accommodate movement of said decorative cover between said first and second positions.

6. A door chime as claimed in claim 5, wherein said slide plate has flat sides engaging a slot in said front cover, for preventing rotation of said decorative cover as the decorative cover slides between said first and second position.

7. A door chime as claimed in claim 6, wherein said slide plate has a protrusion on a flange which releasably engages a detent divot in said front cover when in said first position.

* * * * *